United States Patent [19]

Rossborough

[11] 4,109,635

[45] Aug. 29, 1978

[54] MACHINE GROOVED JOINT ON HOLLOW CONCRETE CYLINDERS

[76] Inventor: John C. Rossborough, 8 Upper Flanders Rd., Amherst, N.H. 03031

[21] Appl. No.: 722,266

[22] Filed: Sep. 10, 1976

[51] Int. Cl.[2] ..... B28D 1/16

[52] U.S. Cl. ..... 125/10; 51/241 B; 51/241 S; 264/154; 264/162

[58] Field of Search ..... 264/138, 154, 162; 125/10; 51/241 B, 241 S

[56] References Cited

U.S. PATENT DOCUMENTS

| | | | |
|---|---|---|---|
| 2,607,376 | 8/1952 | Montgomery | 125/10 |
| 2,984,886 | 5/1961 | Jessen | 125/10 X |
| 3,187,738 | 6/1965 | Christopher | 125/23 R X |

*Primary Examiner*—Thomas P. Pavelko
*Attorney, Agent, or Firm*—Pearson & Pearson

[57] ABSTRACT

A bell and spigot joint of reinforced concrete manhole risers, or pipes, or abutting joints therein are improved by precasting the same, free or pre-cast grooves in the exterior faces intended for seating sealing rings. After pre-casting and curing in the kiln, the hardened, cured surfaces are machined to form a sealing ring groove proximate the ends thereof, for example around the spigot of a bell and spigot joint. The inside of the bell is also machined to hone the same to a smooth finish. The grooving apparatus is precisely centered on the axis of the member to produce a groove of uniform radius relative thereto.

7 Claims, 10 Drawing Figures

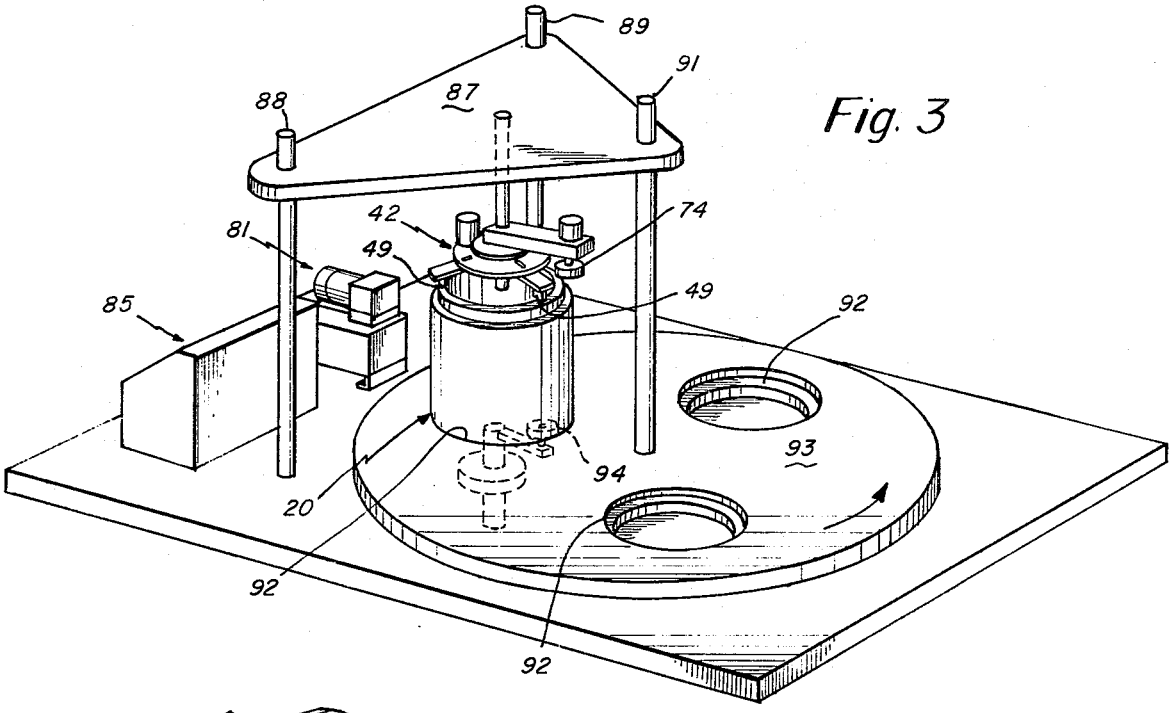
Fig. 3
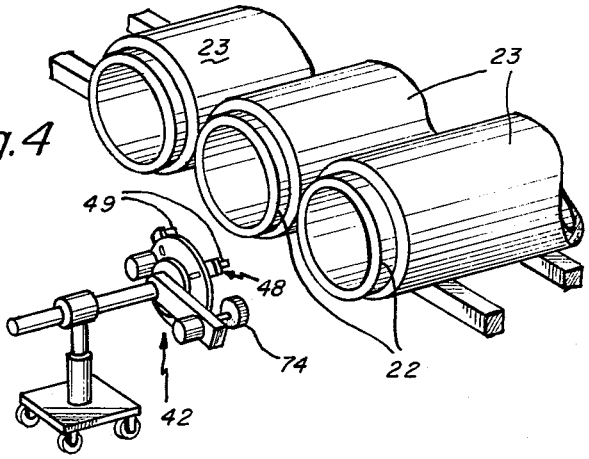
Fig. 4
Fig. 10
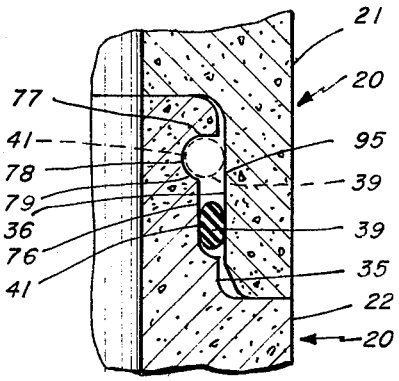
Fig. 5
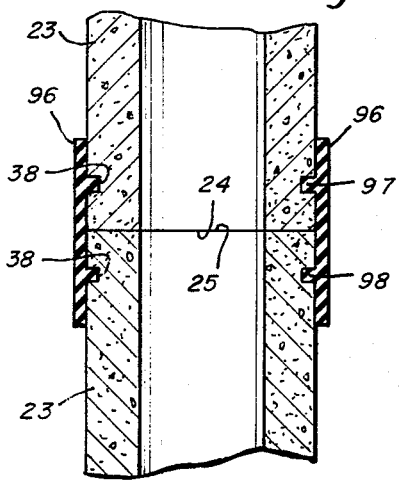
Fig. 6
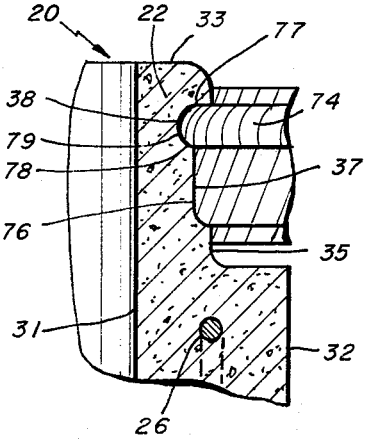
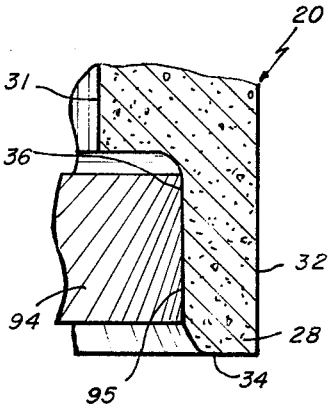
Fig. 7

MACHINE GROOVED JOINT ON HOLLOW CONCRETE CYLINDERS

BACKGROUND OF THE INVENTION

In the reinforced concrete pipe art, it has long been the custom to cast sections by machine, the grid of reinforcing metal rods being placed in a form and the form placed in the machine. The form is so shaped as to produce a bell at the lower end and a spigot at the upper end so that a bell and spigot joint may be created between two adjacent members.

It has also been the custom to form a shallow annular groove in the spigot, to seat the conventional sealing ring, or O ring, just inside the tip flange of the spigot. Upon inserting the spigot in the bell of another member, the sealing ring rolls out of the groove and along the tapered mting surfaces of the bell and spigot until a tight seal is achieved.

It will be understood that there are usually no reinforcing rods in the spigot, that the spigot is of less wall thickness than the main body, and that the spigot is upstanding above the main body when pre-cast and moved from the casting machine into the kiln. The bell on the other hand, while also of reduced wall thickness, is transported into the kiln with its reinforcing mold ring in place so that it has no tendency to lose its integrity.

It has been found that the spigot of such pre-cast reinforced concrete hollow cylindrical sections may tend to slump slightly, or to have flats and that the pre-cast groove extendng therearound is therefore not a true circle and is not of uniform radial distance from the central longitudinal axis of the riser.

It will be understood that it is diffcult enough to obtain the correct rolling movement of a sealing ring out of its groove and into firm contact with the opposed surfaces of bell and spigot, lubrication often proving necessary, without the added hazard of a groove which has been pre-cast with a flat, or bump or other defect.

DESCRIPTION OF THE PRIOR ART

It has heretofore been proposed in U.S. Pat. No. 2,807,921 to Dewing of Oct. 1, 1957 to affix a circular track around a reinforced concrete, solid, upstanding pile and to manually move a carriage around the track while manually turning a thrust screw to move a circular saw into the pile to cut off its top. The exact depth of cut need not be controlled in such a device because cut off is the object and not the creating of a truly circular shallow sealing groove.

In U.S. Pat. No. 3,617,142 to DeWane of Nov. 2, 1971 a circular track is mounted across the open end of an upstanding hollow cylindrical member so that vertically movable drills may form holes in the rim parallel to the axis. The workpiece in this instant has a projecting annular rim flange so that leveling an clamping is accomplished by means of the flange.

In my U.S. Pat. No. 3,958,313 of May 25, 1976 there is disclosed an apparatus for core drilling a hole in the side wall of a manhole riser, the apparatus being suspended from the rim outside the riser or being mounted alongside the riser on a truck or factory floor. Such a core drill, movable around the open end of a manhole riser could probably be adapted to cut a sealing ring groove in a spigot but this assumes that pre-cast spigots are always accurately formed which is not necessarily the case.

All of the above mentioned patents, while teaching the forming of a cut, or hole, in a cylindrical object, fail to disclose power driven carriage means for advancing the cutter around the cylindrical object in a true circular path while producing a groove of uniform radius relative to the axis of the member.

SUMMARY OF THE INVENTION

In this invention the presence of an inaccuracy in the configuration of the inside face, or the outside face, or the hollow cylindrical, reinforced-concrete workpiece is overcome by mounting the circlar track across the open end of the piece and accurately centering it on the central longitudinal axis of the workpiece. Extendable adjustable internal centering guides project down into the hollow workpiece for engagement with the inner face, outer guides spaced around the track structure engage over the outer peripheral edge of the workpiece and the track structure includes a heavy counterweight depending from the track structure down into the hollow workpiece.

Thus the circular track structure is precisely centered to position the cutter head and cutter, which are cantilevered from the track structure out beyond the confines of the workpiece, at the correct radial distance from the axis to follow a truly circular path of the said radius all around the workpiece.

The track structure preferably includes a ring gear and the carriage includes a motor driven spur gear meshed therein for advancing the carriage around the track at a controlled velocity. The carriage includes a radially extending linear track for guidng the cutter head inwardly and outwardly, there being a piston and cylinder mechanism for controlling the linear travel of the cutter head. The cutter head includes an hydraulic motor for driving the cutter and preferably the counterweight is an hydraulic system including an electric motor, hydraulic pump and suitable hydraulic flexible conduits for driving the carriage, the cutter head and the cutter.

BRIEF DESCRIPTION OF THE DRAWING

FIG. 3 is a perspective. schematic view of still another embodiment of the invention in which the frame and track structure is mounted on vertical posts and the risers are supported on turntable mechanism;

FIG. 4 is a perspective, schematic view of still another embodiment of the apparatus showing the grooving of the ends of horizontally disposed pipes;

FIG. 5 is an enlarged, fragmentary, sectional view showing one form of joint between abutting hollow cylindrical members;

FIG. 6 is an enlarged, fragmentary sectional view of the cured, hardened pre-cast face of a spigot being machine grooved by a cutter;

FIG. 7 is an enlarged, fragmentary sectional view of the cured, hardened pre-cast face of a bell being machine honed by a grinder;

FIG. 10 is a sectional view similar to FIGS. 6 and 7 showing a sealing gasket in the bell and spigot joint of the invention.

DESCRIPTION OF THE PREFERRED EMBODIMENTS

Figure 1:
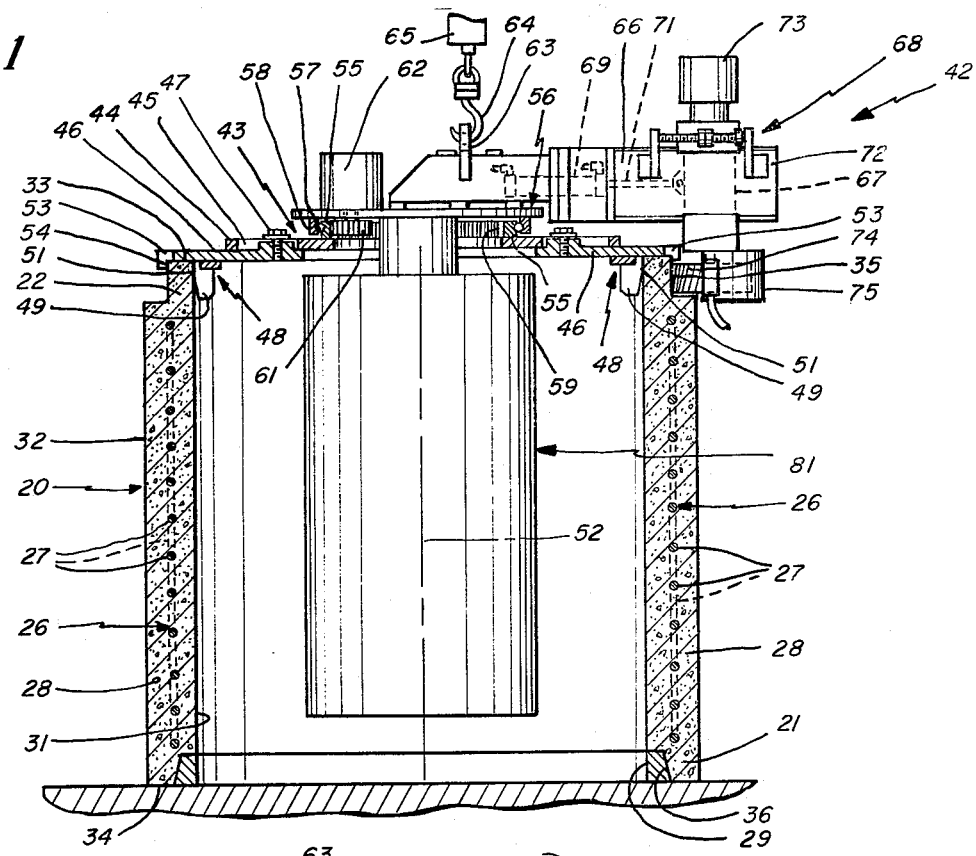
FIG. 1 is a side elevation partly in section showing the apparatus of the invention grooving the spigot of a manhole riser.

As shown in the drawings, typical hollow cylindrical, pre-cast, reinforced concrete, members such as manhole risers 20 each having a bell end 21 and a spigot end 22, or elongated pipes 23 each having ends 24 and 25 intended to abut, must be sealed at the joints.

Manhole risers 20, and pipes 23, when of reinforced concrete, include a reinforcing grid 26 of metal wires, or rods, 27 and the cement usually includes aggregate 28. The grid 26 does not extend into the bell end 21 or spigot end 22 so that no internal support is offered thereby during centrifugal casting in a mold or during curing and hardening when the pre-cast members are transported into a kiln and cured therein. Usually an annular metal caasting ring 29 is however left in place to support the bell end upon which the riser rests during curing, whereupon it is removed.

Each east section 20 includes an inner cylindrical wall, or face, 31, an outer cylindrical wall, or face, 32, a pair of opposite annular, planar end walls, or faces 33 and 34, a side wall or face 35 on the spigot 22 and a side wall, or face, 36 on the bell, 21.

Prior to this invention it has been the practice to shape the pre-cast mold at the spigot end 22 thereof, to form a truncated conical surface 37 with an annular sealing ring groove 38 therein, in the side face 35 of the spigot, the groove further reducing the thickness of material of the spigot. It has been found, that such pre-cast tapered, grooved, upstanding spigots tend to slump in the kiln, and may develop flats, protuberances, recesses and otherwise harden with a groove which is not a precise annulus of uniform radius. When a sealing ring 39, usually of flexible resilient material such as rubber, and of solid circular cross section has its inner portion 41 seated in such an inaccurate groove and the spigot is inserted in the bell end of another riser, the ring 39 may fail to roll out of the groove, or may become unduly distorted with the tendency to create a leaking joint. Because the exposed face of the spigot face 35, tapered face 37 and groove 38 as well as the inner face 36 of the bell are of cured, hardened, rough concrete, the sealing ring 39 may require the time consuming task of being lubricated to cause it to rollably perform its function of creating a tight, leak proof joint.

The apparatus 42 of the invention includes innular frame means 43 having an annular plate 44 provided with a plurality of radial slots 45 in each of which a support 46 is slidable. The supports 46 are extendable to support the frame means 43 on risers of various diameters and each support is tightenable in its slot by suitable clamp bolts 47.

Centering means 48, comprises a plurality of internal centering guides 49, each depending from a support 46 down into the hollow cylindrical riser so that the outer face 51 of each guide 49 engages the inner cylindrical face 32 of the riser to centre the frame means at a uniform radial distance from the central longitudinal axis 52 of the riser 20. A plurality of clamp elements 53 are mounted on the supports 46, each arranged to grip the peripheral edge 54 of the side face 36 of the spigot to constitute external centering guides. Thus the internal centering guides 49 and the external centering guides 53 are extendable on supports 46 to not only support the frame means 43 on the end face 33 but also to centre the frame means on the riser.

The frame means 43 includes a rigid circular track 55 around which the carriage means 56 rotates by means of ball bearings 57 in a ball bearing race 58 on the outside of the track. The track structure 55 is of rigid material and includes the ring gear 59 on the inside thereof.

The carriage means 56 includes a spur gear 61, meshed in ring gear 59, and driven hydraulic rotary motor 62 at a controlled velocity which may be about three feet per minute. Motor 62 is designated second power means herein. An eye plate 63 is welded to the central portion of carriage means 56 so that a crane hook 64 of a crane 65 can lift the apparatus 20 into place on the top rim of a riser 20.

Carriage means 56 includes a linear track 66, extending radially relative to the axis 52, in which the cutter head 67 of cutter head means 68, is slidable for radial movement inwardly and outwardly relative to the axis 52. A cylinder 69 and piston 71 activated by hydraulic fluid is operably connected to the cutter head 67 to move the same, and the piston and cylinder mechanism is designated the third power means herein.

The cutter head 67, outer portion 72 of linear track 66, hydraulic motor 73 and the rotary milling cutter 74 driven by motor 73, are all cantilevered from frame means 43 out beyond the confines of the upstanding riser 20, so that the cutter can groove the side face 35 of the spigot. A steel guide 75 is mounted around the cutter and water is sprayed at the cut to cool the diamond tipped cutter while washing away the concrete particles. The motor 73 is designated the first power means herein.

As best shown in FIG. 6 the pre-cast hardened, cured outer face 35 of the spigot is cylindrical, but the cutter 74 opens up fresh smooth surfaces including the truncated conical cut face 76, the groove end walls 77 and 78 and the inner, or bottom, groove wall 79, the latter being at a uniform radial distance from the axial centre line 52 of the riser 20.

An hydraulic unit, or system 81 including an electric motor 82, and an hydraulic pump 83 depends downwardly from carriage means 56 into the hollow cylindrical riser 20, and along centre line 52, the unit rotating with the carriage. The pump 83 is connected by suitable flexible hydraulic conduits 84 to the hydraulic rotary motor 73, the hydraulic motor 62 and the cylinder 69 for driving the same at predetermined rates, these being the first, second and third power means respectively. The hydraulic unit 81 is relatively heavy and serves as a counterweight to the cantilevered cutter head and cutter to retain the frame means and carriage means in place.

Figure 2:
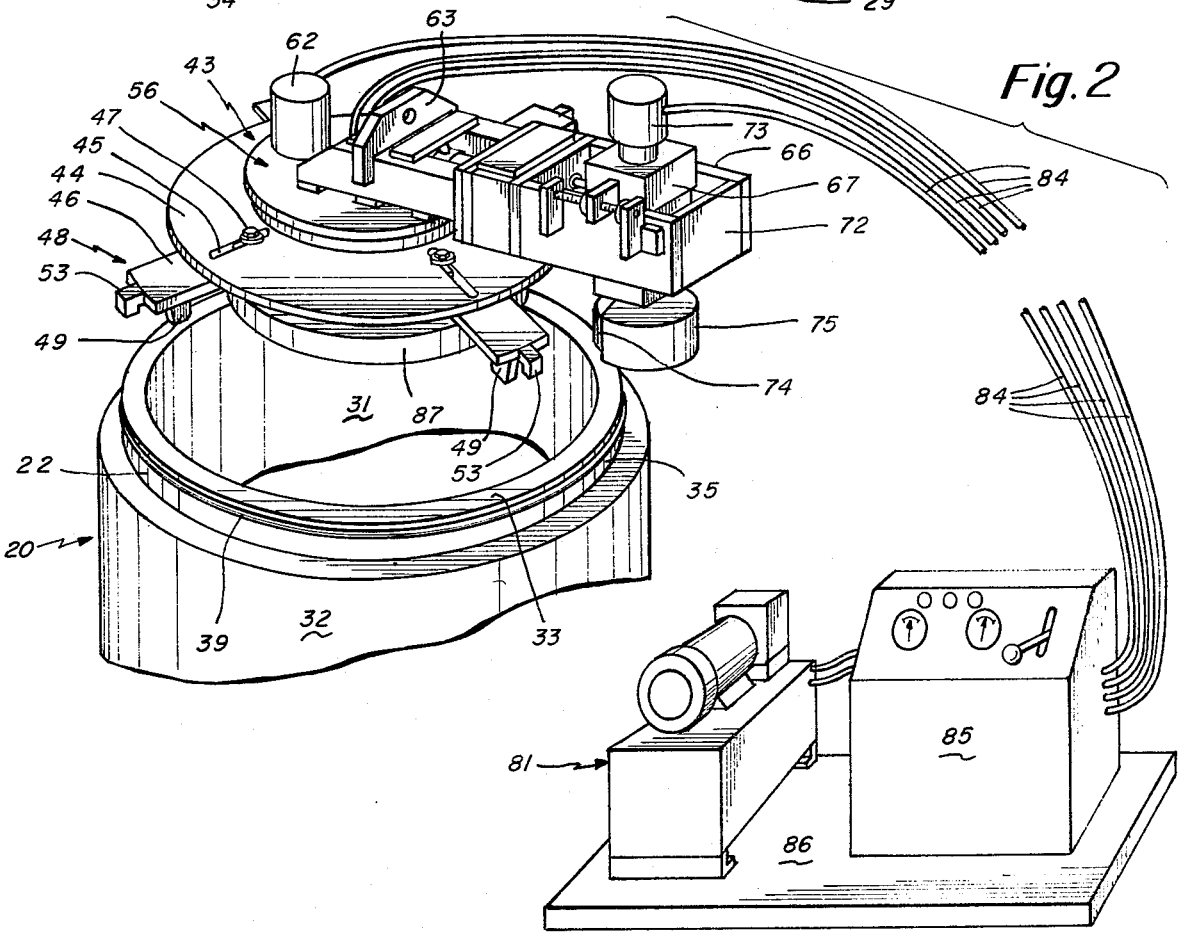
FIG. 2 is a perspective, schematic view of another embodiment of the apparatus, wherein the hydraulic system is separate from the frame and track structure.
Figure 8:
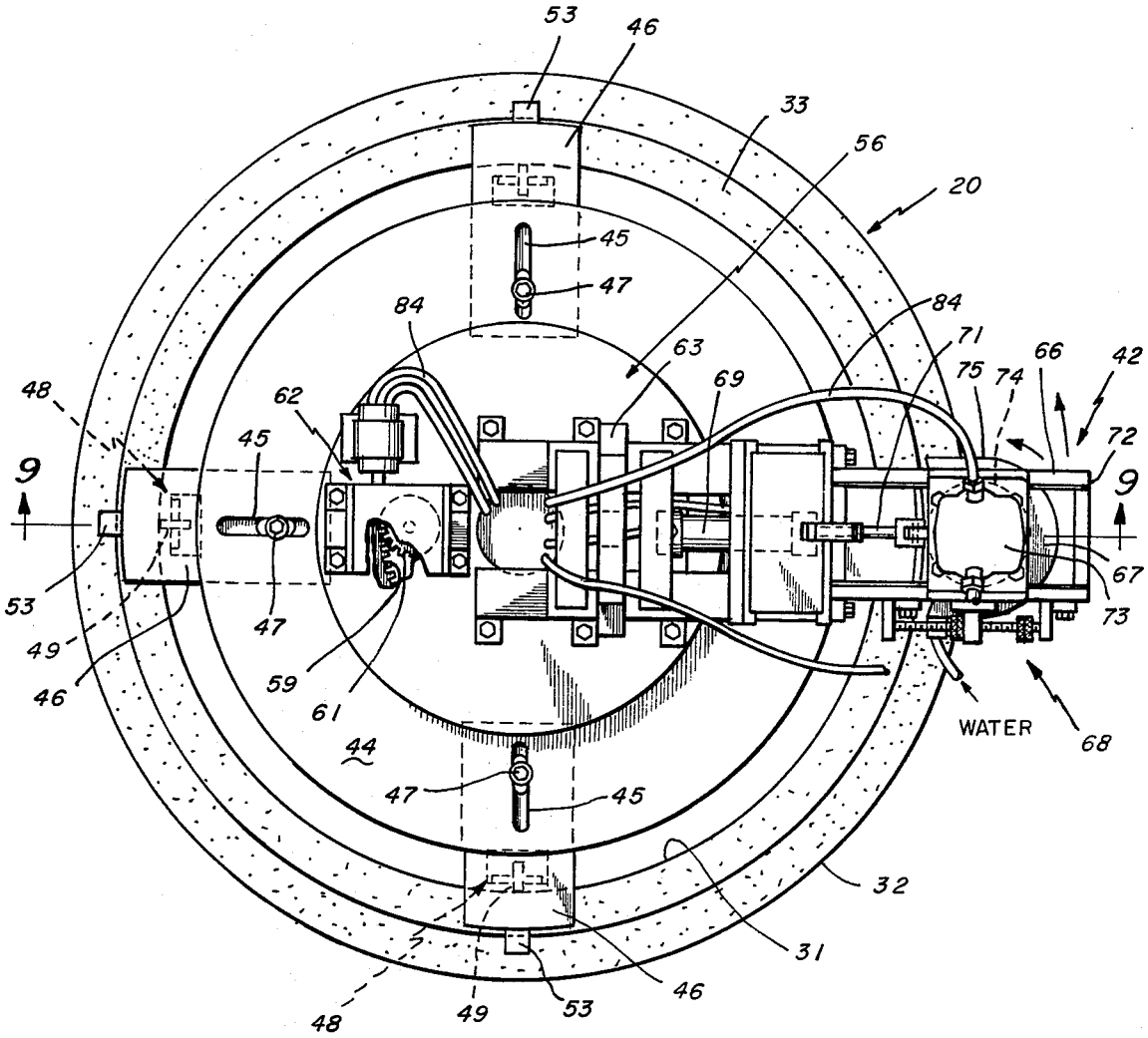
FIG. 8 is an enlarged top plan view of the apparatus of the invention with parts broken away.
Figure 9:
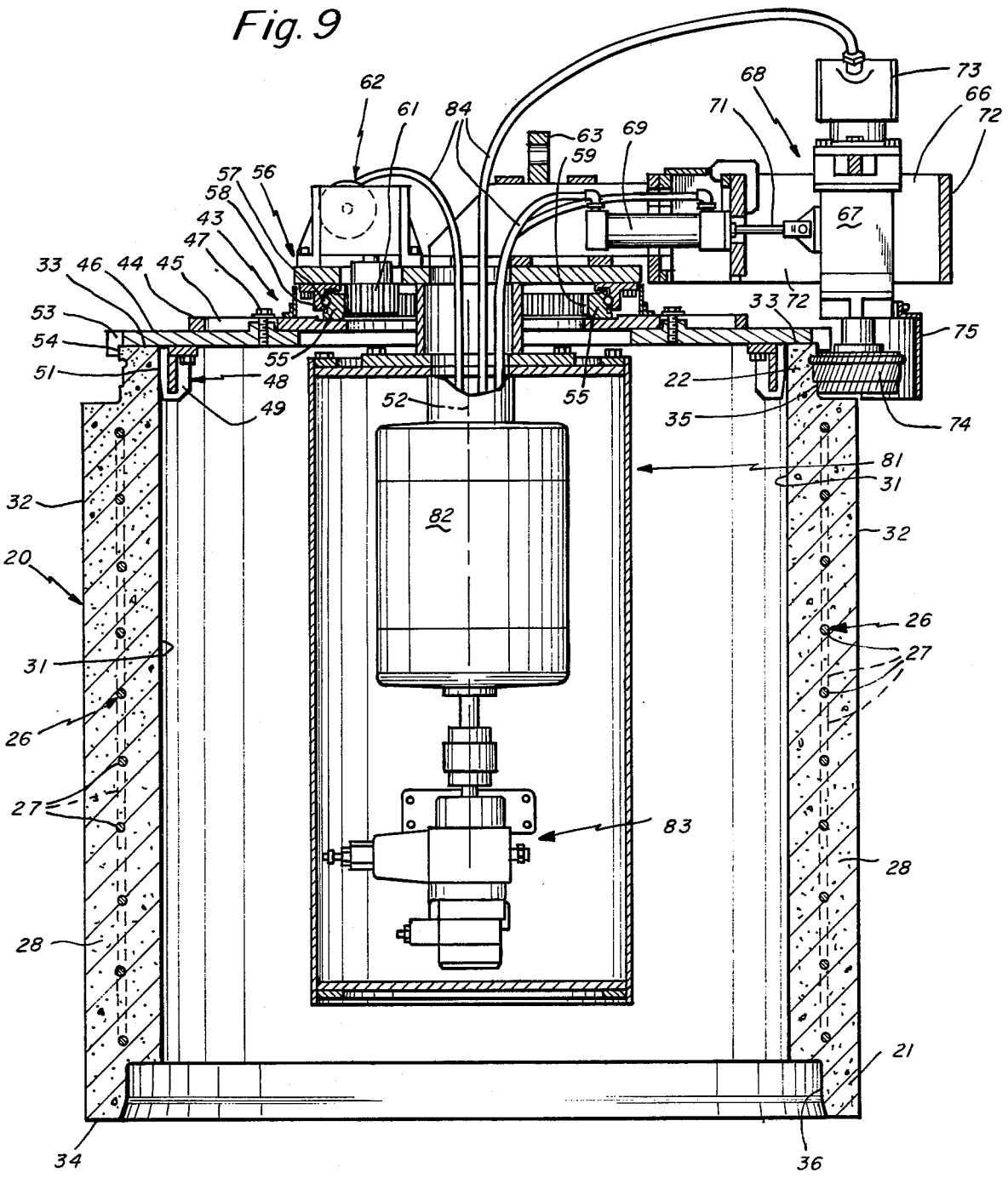
FIG. 9 is a side elevation in section on line 9—9 of FIG. 8 showing the apparatus of the invention.

As shown in FIG. 2, the hydraulic unit 81 and a control console 85 may be separated from the frame means 43 and carriage means 56 and mounted on a platform 86 alongside the riser 20. A suitable counterweight 87 is provided to depend from the carriage down into the riser.

In FIG. 3 an apparatus 42 of the invention is mounted under an element 87 sleeved on a plurality of vertical posts 88, 89 and 91 for vertical movement thereon so that it can be lowered onto a riser 20 carried on one of the bases 92 of a turntable 93. The hydraulic unit 81 and console 85 are mounted alongside the work station and it should be noted that the bases 92 are hollow and may also be turntables. As the cutter 74 machines a sealing ring groove in the spigot, a rotary grinder 94 simultaneously machine hones the inner side face 36 on the bell of the riser to smooth and true and same for rolling contact with the sealing ring 39. The fresh exposed, honed face of the bell is designated 95.

As shown in FIG. 4 the apparatus 42 of the invention may be applied to the ends of reinforced concrete pipes 23, laid horizontally, the larger diameter such pipes usually having bell and spigot ends. The internal centering guides 49 and clamp elements 53 of centering means 48, position the frame means and carriage means across the open end of each successive pipe halted at the work station.

As shown in FIG. 5, when such pipes are to be joined with abutting ends 24 and 25, with no bell and spigot joint, the cutter 74 machined grooves 38 in the outer cylindrical face of each pipe proximate an end 24 and 25 and a sealing ring 96 is wrapped around the joint with a rib 97 or 98 in each groove.

The sealing ring, or gasket, 39, the machined, truncated-conical surface 76 and the machined sealing ring groove walls 77, 78 and 79 of spigot 22 and the machined inner surface 95 of bell 21 are all described herein in the form of the "ROL-N-LOK" joint, well known in the trade and a product of National Pollution Control Systems, Inc. of Nashua, New Hampshire. However, the apparatus and method of the invention is applicable to any of the gasketed joints used in the trade such as "trapped O-rings," single offset, double offset and others known to those skilled in the art.

I claim:

1. The method of machining an annular groove around the exterior surface of the spigot end of a reinforced concrete manhole riser by means of a circular track frame mounted across said spigot end, a carriage mounted to move around the circular track, a linear track extending radially on said carriage, a cutter head movable along said linear track and a rotary cutter depending from said head, said method comprising the steps of precisely centering said circular track frame relative to the longitudinal axis of said riser, power moving said carriage around said circular track frame at a controlled velocity, power rotating said rotating cutter of said cutter to rotate in a horizontal plane on a vertical axis;

and power moving said cutter head along said linear track to a position thereon to form an annular groove in said spigot end said groove having an inner wall at a predetermined, uniform radial distance from said axis as said carriage travels in a circular path around said axis.

2. A method as specified in claim 1 plus the steps of cantilevering said cutter head, cutter and the drive motor therefor on said linear track out beyond the confines of said riser and counterweighting the same by a hydraulic power system depending from said carriage down within said riser and rotatable with said carriage.

3. A method as specified in claim 1 plus the steps of power moving said carriage, cutter head and cutter hydraulicly, through flexible conduits connected to a remote hydraulic power system.

4. A method as specified in claim 1 plus the step of shaping said rotary cutter to not only form a groove for an O ring but simultaneously to taper a surface upon which said O ring may roll and surfacing said rotary cutter with diamonds to simultaneously machine the entire spigot end surface in one pass around said end after said surface has cured and hardened.

5. A method as specified in claim 1 wherein said step of centering said circular track frame includes the steps of clamping external centering guides and internal centering guides on the rim of the open end of said riser.

6. A method as specified in claim 1 plus the step of smoothing the inside face of the bell end of said riser by rotary machining said face simultaneously with said step of rotary milling said groove in the spigot end thereof.

7. The method of machining an annular groove around the spigot end of a manhole riser, by means of a rotary cutter head movable radially on the linear track of a carriage, the carriage being movable in a circular path around a frame, supported across said spigot end, said method comprising the steps of power rotating the cutter of said cutter head power moving said cutter head and cutter inwardly on said linear track to form a part of a groove in said spigot end to a predetermined depth and power moving said cutter head, cutter and track on said carriage in a circular path around said spigot end at a uniform radial distance from the central longitudinal axis of said riser to complete said groove around said spigot end.

* * * * *